United States Patent [19]

Dalebout

[11] 4,182,056

[45] Jan. 8, 1980

[54] PLIABLE INNER BOOT AND INJECTABLE FIT PACKS FOR SKI BOOTS

[75] Inventor: Melvin W. Dalebout, Salt Lake City, Utah

[73] Assignee: Engineered Sports Products, Inc., Salt Lake City, Utah

[21] Appl. No.: 883,460

[22] Filed: Mar. 6, 1978

Related U.S. Application Data

[63] Continuation-in-part of Ser. No. 711,476, Aug. 4, 1976, Pat. No. 4,078,322.

[51] Int. Cl.[2] ..... A43B 5/04; A43B 19/00; A43D 9/00

[52] U.S. Cl. ..... 36/117; 36/71; 12/142 P

[58] Field of Search ..... 12/142 R, 142 P; 36/117, 118, 119, 120, 121, 71

[56] References Cited

U.S. PATENT DOCUMENTS

| | | | |
|---|---|---|---|
| 2,884,646 | 5/1959 | Alber | 36/71 |
| 3,925,916 | 12/1975 | Garbuio | 36/71 |

FOREIGN PATENT DOCUMENTS

| | | | |
|---|---|---|---|
| 2308547 | 2/1973 | Fed. Rep. of Germany | 36/71 |
| 2368239 | 10/1976 | France | 36/117 |

*Primary Examiner*—Patrick D. Lawson
*Attorney, Agent, or Firm*—Trask & Britt

[57] ABSTRACT

A pliable inner boot for insertion within a rigid outer shell of a ski boot is formed of resinous foam material. The inner boot is bifurcated at the front, and is provided with recesses in the vicinity of the shin region and preferably at the heel pocket. These rcesses soften the feel of the inner boot at the shin and ankle regions when it is compressed by closure of the rigid outer shell.

A pliable custom fitting reservoir (fit pack) is interposed between the rigid outer shell and the inner surface of the inner boot in the vicinity of the heel pocket and the instep portions of the inner boot. This reservoir may be either integral with or separate from the inner boot. It may include a conduit adapted to receive a liquid resin reaction mixture from a source remote from the ski boot. Alternatively, the fit pack may contain isolated components of a reaction mixture which are mixed by kneading just prior to use.

25 Claims, 11 Drawing Figures

PLIABLE INNER BOOT AND INJECTABLE FIT PACKS FOR SKI BOOTS

RELATED PATENT APPLICATIONS

The present application is a continuation-in-part of commonly assigned U.S. patent application Ser. No. 711,476 for "Ski Boot," filed Aug. 4, 1976, now U.S. Pat. No. 4,078,322.

BACKGROUND OF THE INVENTION

1. Field

This invention pertains to ski boots of the type in which an inner boot is removably placed within a rigid outer shell. Specifically, it provides both an improved pliable inner boot and an injectable fit pack adapted for custom fitting inner boots of this type to individuals of varying foot characteristics.

2. State of the Art

Over the past several years, ski boots have evolved through several stages from stiff unlined boots of leather to the present rigid outer boot shells (generally of plastic) with flexible liners of various types. For use with modern bindings, it is essential that the outer boot be stiff to optimize the control effected on the skis by a skier shifting his weight or the attitude of his feet. On the other hand, the inner boot desirably provides for adequate comfort so that the skier can tolerate wearing the boots for extended periods.

Inner boots have been sold with ski boots for many years. More recently, some of these inner boots have been constructed for microcellular foam material. Some of the prior art inner boots have included bladders adapted to receive injections of moldable materials. Although various injection techniques have been used to custom fit inner boots to individual feet, the industry would prefer to avoid such techniques. Injection techniques are capable of producing an excellent fit, but care and experience beyond the level typically available at the retail level are required for consistently satisfactory results.

To avoid the problems experienced at the retail level from custom fitting methods involving the injection of elastomeric material to custom fit the inner boot to an individual's foot, various types of so-called "flow" systems have been tried. Although a satisfactory fit is usually obtained initially by these methods, the fit is usually of temporary duration. Moreover, flow systems tend to reflow upon storage of the boots necessitating refitting after prolonged storage or transport under varying heat conditions. Accordingly, a large segment of the industry has moved towards systems which rely upon other expedients, such as insertable pads or wedges, to adapt a ski boot to an individual's foot. These methods are laborious. Although they can accomplish a reasonably good fit, they cannot achieve an ideal custom fit as was generally the case with injectable systems.

Custom fitting systems of the prior art are disclosed by U.S. Pat. Nos. 3,377,721; 3,410,004; 3,581,412; and 4,068,337. Typical flow fit systems are disclosed by U.S. Pat. Nos. 3,237,319; 3,786,580; and 3,402,411. Some of these patents also disclose inner boots of microcellular foam.

The parent application discloses and claims a ski boot with a rigid outer shell of novel construction together with a novel removable inner boot of improved design. The inner boot is disclosed as being of pliable resinous foam material, bifurcated at the front without a tongue.

Generally, the inner boot is bifurcated at the front with a first side overlapping a second side, the overlapping portion of said first side being received by a recessed portion of the second side. Ideally, the inner boot includes tabs integral with the outer surface and extending out from the vicinity of the heel but behind and beneath the portion of the pliable boot which receives the ankle bone of a foot. These tabs are adjacent the region known in the industry as the "heel pocket." The present application discloses and claims certain improvements to the type of inner boot disclosed and claimed by the parent application. Also disclosed and claimed is an injectable fit pack for use together with such inner boots, either as an integral portion thereof or as a separate member.

The disclosure of the parent application is incorporated herein by reference to the extent that it is applicable hereto.

SUMMARY OF THE INVENTION

The inner boot of this invention is substantially similar to that disclosed and claimed by the aforementioned parent application. That is, it is a pliable, resilient boot of padding material, such as polyurethane microcellular foam. It preferably includes a wear-resistant inner liner, ideally formed as a sock constructed of "wet suit" material; for example, a two-way stretch fabric, usually nylon; bonded to a closed cell foam backing. The microcellular inner boot is typically foamed in place about a mandrel and forms a bond with the closed cell foam backing of the inner liner. As disclosed in the parent application, it is highly desired that the inner boot include heel tabs carried on each side behind and below the region adjacent the ankle bone. These spacers urge the inner boot walls in towards the foot of the skier, contributing to a snug fit in the vicinity of the heel. In many instances, these spacers alone effect a sufficiently snug fit in the vicinity of the heel without resort to additional custom fitting procedures.

According to this invention, recesses are provided forward of these heel tabs in the vicinity surrounding the ankle bone. These recesses provide pressure relief to the sensitive ankle region. When the outer surface of the inner boot is compressed around the lower leg by the rigid outer shell, the exterior detents provided in the inner boot allow the walls of the inner boot to flex out toward the shell. Additional recesses (detents) are provided in the inner boot exterior surface along the front of the inner boot in the lower leg portion of the inner boot, generally to the inside of the center of the lower leg. These recesses provide a softening effect for additional comfort, particularly in the shin region. Other recesses are provided on the exterior surface of the inner boot to register with hardware, such as rivets, carried by the outer boot, thereby avoiding any transfer of pressure from these elements to the skier's leg. A similar recess may be provided at the back just above the heel portion of the inner boot.

Although the aforedescribed inner boot avoids the necessity for much of the custom fitting heretofore deemed necessary to achieve a satisfactory ski boot fit, individual differences in anatomy still make custom fitting on a reduced scale desirable for many individuals. According to this invention, such custom fitting is provided by a special injectable fit pack. The fit pack may either be constructed as a separate device for insertion between the inner boot and outer shell, or it may be formed integral with the inner boot itself. The fit pack comprises a pliable reservoir interposed between the rigid outer shell of the ski boot and the inner surface of the inner boot in the vicinity of the heel pocket, ankle and the instep portions of the inner boot. Ideally, the fit pack is formed as a double-walled reservoir wherein the walls form a cavity. According to some embodiments, the cavity is in open communication with a conduit which may be used either to inject an unreacted liquid reaction mixture or to exhaust excess of such a mixture during or prior to reaction of the components in the mixture. Ideally, the reservoir is configurated as an annular band surrounding the shin and instep portions of the inner boot. According to some embodiments, components of a liquid reaction mixture may be prepackaged in segregated compartments within the reservoir. The barrier between these compartments is broken, and the components mechanically mixed by kneading action before insertion of the fit pack in position between the outer boot and inner boot.

BRIEF DESCRIPTION OF THE DRAWINGS

In the drawings, which represent what is presently regarded as the best mode for carrying out the invention.

DESCRIPTION OF THE ILLUSTRATED EMBODIMENTS

Figure 1:
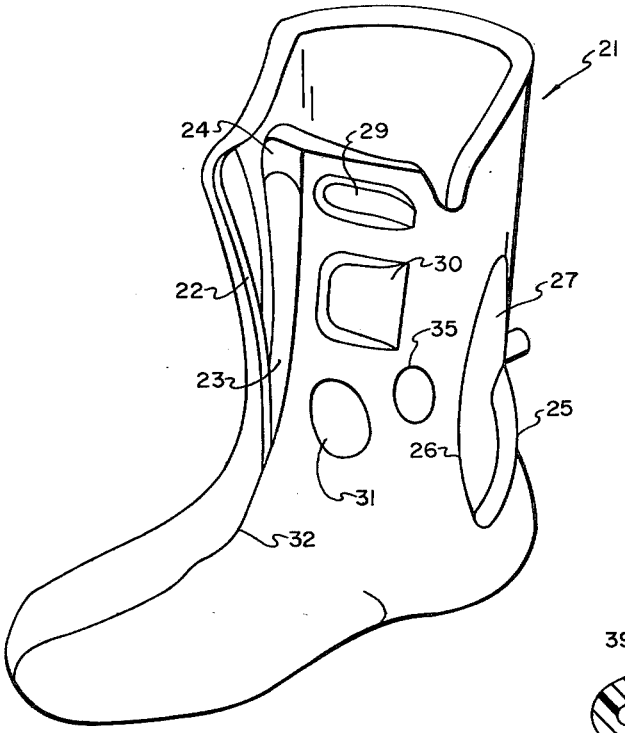
FIG. 1 is a pictorial view of an inner boot of this invention.
Figure 2:
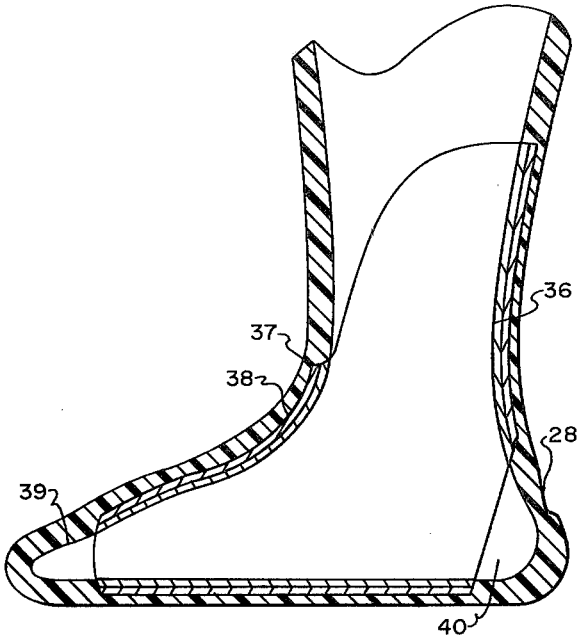
FIG. 2 is a cross-sectional view of the inner boot of FIG. 1.
Figure 3:
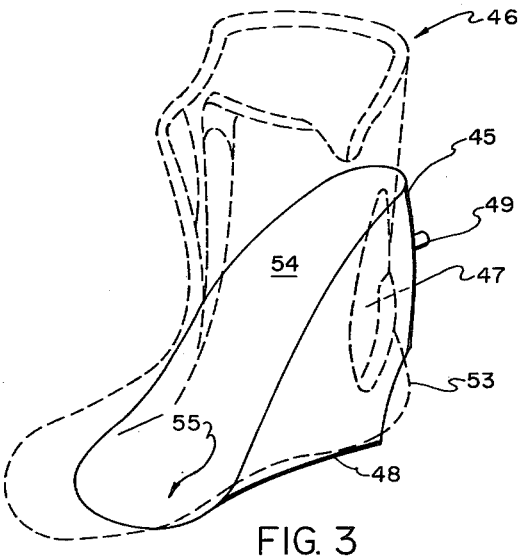
FIG. 3 is a pictorial representation of one form of fit pack of this invention and its positional relationship with respect to an inner boot of FIG. 1 shown in phantom.

The inner boot 21 illustrated by FIGS. 1 and 2 and shown in phantom lines in FIG. 3 is formed of a pliable material such as microcellular polyurethane foam and is of the general type described and claimed in the parent application, Ser. No. 711,476. It is bifurcated at the front so that it opens with an outer flap 22 adapted to seat into a recess 23 provided in an inner flap 24. The inner boot 21 thus avoids the use of a separate tongue and provides a substantially continuous smooth innersurface against the front of a skier's leg. A heel tab 25 is carried on each side of the inner boot 21 behind and below the region 26. A recess or detent 27 is provided on the exterior surface of the inner boot 21 forward of each tab 25. The tabs 25 urge the inner boot walls in toward the foot of the skier ensuring a snug fit in the vicinity of the heel. The recesses 27 provide a softening effect of the inner boot in this region because of the space they provide for outward flexure of the inner boot. A similar recess 28 (FIG. 2) may be provided at the back of the inner boot in the vicinity above the heel. Other pressure relief detents 29, 30, 31 are provided on the inner flap 24 following generally the perimeter 32 of the recess 23. These detents provide a softening effect in the portion of the inner boot extending up from the inside portion of the inner boot towards the center of the shin, the region of greatest pressure sensitivity when the outer boot (not shown) is clamped around the inner boot in use. Additional detents, such as the detent 35 shown, may be provided as needed to register with hardware, such as rivet heads, associated with the outer boot shell.

As shown, the inner boot 21 includes a wear resistant inner liner 36. Ideally, the inner liner 36 is formed as a sock constructed of "wet suit," e.g., a two-way stretch fabric 37, usually nylon, bonded to a closed cell foam backing 38. Typically, the inner liner 36 will lock portions of the toe 39 and heel 40.

FIG. 3 illustrates one form of a fit pack 45 of this invention in association with an inner boot 46, (which may be an inner boot as disclosed herein, the parent application Ser. No. 711,476, or many other of the removable inner boots in current use). As illustrated, the fit pack is a pliable custom fitting reservoir which, when located as shown in FIG. 3, is interposed between the rigid outer shell (not shown) and the inner surface of the inner boot in the vicinity of the heel pocket 47 and instep 48 portions of the inner boot 46. It should be recognized that the fit pack 45 may be a separate component placed as shown in FIG. 3 adjacent the exterior of the inner boot 46, or it may be implanted within the inner boot structure. In the latter case, when a fit pack of the type illustrated by FIGS. 3 and 4 is used, provision is made for the conduit 49 to protrude from the rear of the inner boot 46.

The fit pack reservoir 45 is formed as a band surrounding the inner surface (FIG. 2, 36) of the inner boot in the vicinity of its lower ankle portion and underfoot portion forward of its heel portion to at least its instep portion, generally terminating in the vicinity of the metatarsal heads.

Figure 4:
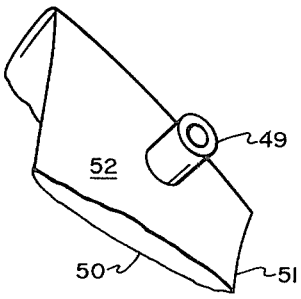
FIG. 4 is a pictorial view, partially broken away of the fit pack of FIG. 3.

Referring specifically to FIG. 4, the pliable reservoir 45 is formed with a first wall 50 having an outer surface and an inner surface and a second wall 51 with an outer surface and an inner surface. These walls are joined so that the inner surfaces define a cavity 52. Means, such as the conduit 49, is associated with the reservoir for introducing a liquid resin reaction mixture into the cavity 52. The walls 50, 51 are shaped as shown so that when they are connected to form the cavity 52 the reservoir 45 is configurated as an annular band defining two opposing openings 53, 54. These openings are adapted to fit with the outer surface of the first wall 50 snugly adjacent a mandrel shaped as a human ankle and foot with the heel portion of the mandrel projecting from the opening 53 and the toe (front) portions of the mandrel projecting from the opening 54. When thus positioned, the cavity 52 includes a member 55 adjacent the instep portion of the mandrel.

By "liquid resin reaction mixture" is meant mixtures of the type heretofore used for custom-fitting ski boots wherein a plurality of reaction components are mixed prior to use to form a reaction mixture. Usually, the components can be segregated into two portions, commonly referred to as "Part A" and "Part B." These "Parts" are mixed to initiate a polymerization reaction. The mixture is configurated within a bladder or other container and allowed to react until it solidifies in that configuration. Polyurethane systems of the type disclosed by U.S. Pat. No. 3,581,412 are especially preferred, although many other polyurethane, silicone rubber, or analgous reaction mixtures are of potential usefulness.

The term "mandrel," as used herein, is intended to refer to either a human foot and lower leg or a structure of similar shape and dimension. This structure might be a human foot and lower leg encased by a stocking or it might be a last or hand tooling of the type illustrated by FIGS. 6 through 9.

The walls 50 and 51 will ordinarily be formed from plastic resin sheet material, such as a flexible vinyl plastic. According to some embodiments, however, the wall 50 may be comprised of a portion of the material making up a wall of the inner boot 46. Such an embodiment is shown by FIG. 5.

Figure 5:
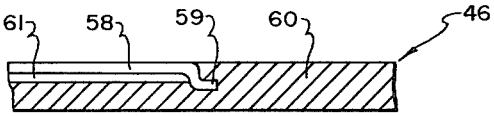
FIG. 5 shows a fragment of an inner boot in enlarged cross-section showing the details of an alternative construction of a fit pack of this invention.

Referring specifically to FIG. 5, a sheet of vinyl plastic 58 or other suitable flexible material impermeable to the liquid resin reaction mixtures used in accordance with this invention, includes a lip portion 59 embedded within the wall 60 of an inner boot such as that illustrated by FIG. 3. A film 61 of parting agent or mold release material is interposed between the sheet material 58 and inner boot wall 60. Accordingly, liquid resin reaction mixture may be introduced between the walls 58 and 60 (which together define a cavity of the type described in more detail in connection with the embodiments of FIGS. 3 and 4). Although reservoirs of the type described by FIG. 5 are within contemplation, it is presently preferred that the reservoir be formed as an annular band constructed as a flat tube. The tube may include an injection port such as the conduit 49 or it may be structured as a self-contained system as described in more detail in connection with FIGS. 10 and 11.

Figure 6:
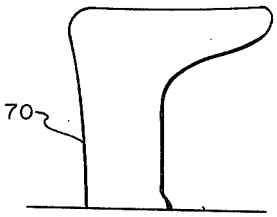
FIGS. 6 through 9 constitute a series of pictorial illustrations showing the steps of a process for forming an inner boot of this invention.
Figure 7:
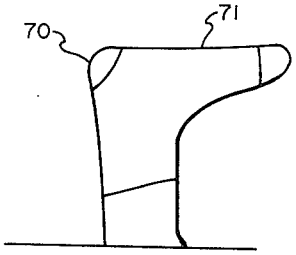
Figure 8:
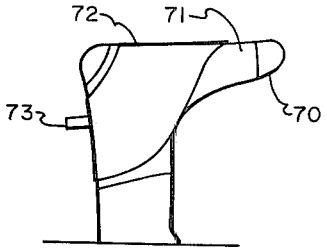
Figure 9:
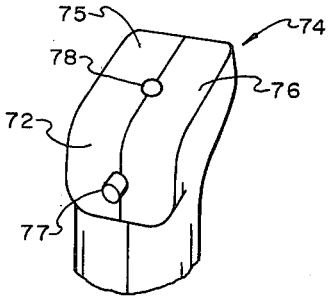

FIGS. 6 through 9 illustrate a method for making a custom fitting inner boot in accordance with this invention. FIG. 6 shows a mandrel 70 in the shape of a human lower leg and foot 70. As may be seen from FIGS. 7 and 8, the usual practice is to first provide an inner liner 71 of the type shown in FIG. 2 (36) over the mandrel 70 as illustrated by FIG. 7. A fit pack reservoir 72 is then placed over the inner liner 71 (FIG. 8). This fit pack 72 may be configurated as generally described in connection with the embodiments of FIGS. 3 and 4 and 5, respectively, and will include an injection conduit 73, usually at the rear of the mandrel as shown in FIG. 8. The mandrel 70 is then enclosed within a shell, designated generally by the numeral 74 in FIG. 9. The shell 74 comprises two halves 75, 76, and surrounds the mandrel so that the mandrel 70 and shell 74 together define an annular space configurated as an inner boot. The assembled shell 74 includes a first port 77 which accommodates the injection conduit 73 of the fit pack 72 and a second port 78 through which a liquid resin reaction mixture is introduced to form the inner boot itself.

Details of the inner boot manufacture and the injection tooling comprising the mandrel 70 and shell 74 are all in accordance with techniques well known to the art. Thus, these details are not elaborated upon in this disclosure. The present invention is concerned with the steps involved in producing a custom fitting inner boot which incorporates as an integral portion thereof the fit pack 72 of this invention.

Although the inner liner 71 is ordinarily a preferred component of the custom fitting inner boots of this invention, it is within contemplation that placement of the inner liner (FIG. 7) may be omitted from the method claimed herein. In any event, inner boots produced in accordance with the method disclosed herein have several interesting and useful characteristics. For example, the fit pack encapsulated in this fashion does not detract from the normal fit of the inner boot. Thus, individuals who require no custom fitting are in no way disadvantaged by the presence of the fit pack. In fact, other than the presence of the conduit 73, the fit pack is scarcely noticeable. The heel tabs 25 are unaffected by presence of the fit pack within the wall of the inner boot. Nevertheless, quantities of liquid resin reaction mixture may be injected through the conduit 73 as needed in specific instances.

In practice, the inner boot is placed within the rigid outer shell of a ski boot, and an individual's foot is placed within the inner boot. The conduit 73 may be extended through an opening in the shell, or it may be trapped between the shell and the inner boot for access through the top. In either case, liquid resin reaction mixture is injected through the conduit 73 and flows through the cavity 52 selectively to regions of lower pressure. The shell may be closed firmly about the inner boot to force excess reaction mixture back through the conduit. After the mixture solidifies, regions of the inner boot which were formerly loose will have acquired a snug custom fit. Compared to custom fitting injection systems of the prior art, very little reaction mixture is required.

Figure 11:
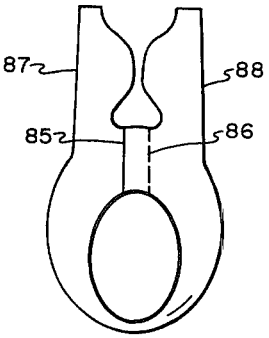
FIG. 11 is a pictorial view of the fit pack of FIG. 10 configurated for use.
Figure 10:
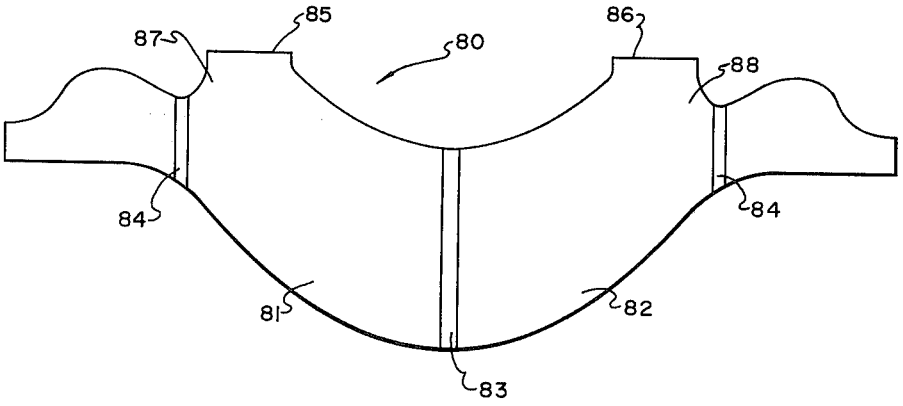
FIG. 10 is a view in elevation of an alternative form of fit pack.

FIGS. 10 and 11 illustrate an alternative form 80 of a fit pack reservoir. It is formed as a flat tube of special configuration which packages within two isolated compartments 81, 82 two components (Parts A and B) required to produce a liquid resin reaction mixture. The two compartments 81, 82 are separated by a barrier seal 83, and are further defined by similar barriers 84 provided at opposite ends of the tube 80. These barriers may be internal seals or they may be external clip devices. Tabs 85 and 86 are carried by the tube 80, and provide means for connecting the tube into a band configuration as shown by FIG. 11. The tube 80 is configurated such that the band (FIG. 11) will take the shape previously described in connection with FIGS. 3 and 4. As may be seen from FIG. 11, these tab members 85 and 86 are overlapped and may be fastened by convenient means such as stapling or gluing. Alternativey, the tab 85 may carry one-half and the tab 86 the other half of a locking mechanism such as "Velcro." Portions 87 and 88 of the tube 80 located opposite the midpoint of the tube from the tabs 85 and 86, respectively, form upward extensions of the tube when configurated as shown by FIG. 11. These extensions 87, 88 form reservoirs to receive excess reaction mixture and extend upward towards the top of the inner boot when the tube 80 is implaced as illustrated by FIG. 3 in connection with the fit pack 45.

The method of custom fitting a ski boot provided by the various embodiments of the fit packs disclosed and described herein are similar. Referring specifically to the use of the fit pack illustrated by FIGS. 10 and 11, just prior to use, the barrier 83 is removed and the components stored in the compartments 81 and 82 are mechanically mixed by a kneading action. Ordinarily, the component stored in compartment 81 will be of a color differing from the component stored in compartment 82. Complete mixing of the two components is indicated by achievement of a uniform color by the mixture. After the components are mixed, the tabs 85 and 86 are connected and the fit pack is positioned with respect to an inner boot 46, as illustrated by FIG. 3, inside the outer shell of a ski boot (not shown). As noted, the tabs 87 and 88 will extend adjacent the exterior surface of the inner boot 46 inside the boot shell. An individual's foot is then placed within the inner boot 46 thereby forcing excess liquid resin reaction from the tube 80. The fit pack reservoir contains liquid resin reaction mixture in its thus displaced condition until the mixture solidifies. The tabs 87 and 88 may be left in place or they may be cut away with a scissors or knife.

It should be understood that reference to certain details of the illustrated embodiments is not intended to restrict the scope of the claims which themselves recite those details regarded as essential to the invention.

I claim:

1. In a ski boot including a rigid outer shell and a pliable inner boot formed substantially completely of resinous foam material from its inner surface to its outer surface, the improvement which comprises:

a pliable custom fitting reservoir interposed between the rigid outer shell and the inner surface of the inner boot in the vicinity of the heel pocket and the instep portions of the inner boot, said reservoir being adapted to contain a quantity of liquid resin reaction mixture and to deform in response to insertion of a foot into said inner boot thereby to form said quantity of reaction mixture into a custom shape and to hold said reaction mixture in said custom shape until it has reacted sufficiently to solidify.

2. An improvement according to claim 1 wherein said reservoir is formed as a band surrounding said inner surface of said inner boot in the vicinity of its lower ankle portion and under foot portion forward of its heel portion to at least its instep portion.

3. An improvement according to claim 2 wherein said band is constructed as a flat tube of material impermeable to said reaction mixture and includes an injection port in open communication with the interior of said tube and adapted to connect to a source of liquid resin reaction mixture remote from said ski boot.

4. An improvement according to claim 1 wherein said reservoir is at least partially embedded in the resinous foam material of said inner boot.

5. An improvement according to claim 1 wherein said inner boot comprises a pliable boot of resinous foam material, bifurcated at the front and without a tongue; and tabs integral with the outer surface of said pliable boot and extending outward from the vicinity of the heel.

6. An improvement according to claim 5 wherein said tabs are adjacent the vicinity behind and beneath the ankle bone region of said inner boot.

7. An improvement according to claim 6 wherein the inner surface of said inner boot is carried by an inner liner bonded to the inside of said pliable boot in the region surrounding the instep and top of the foot portions of said inner boot.

8. An improvement according to claim 7 wherein said inner liner is comprised of a two-way stretch fabric bonded to a closed cell foam substrate, said substrate being bonded to the resinous foam of said inner boot.

9. An improvement according to claim 1 wherein said inner boot is bifurcated at the front with a first side overlapping a second side, the overlapping portion of said first side being received by a recessed portion of said second side.

10. An improvement according to claim 5 wherein said reservoir is at least partially embedded in the resinous foam material of said inner boot.

11. A custom fitting member for use in fitting a ski boot which includes a rigid outer shell and a removable pliable inner boot, comprising:

a pliable reservoir with a first wall having an outer surface and an inner surface and a second wall with an outer surface and an inner surface, said walls being joined so that said inner surfaces define a cavity; and means associated with said reservoir for introducing a liquid resin reaction mixture into said cavity;

said walls being shaped so that when they are connected to form said cavity, the reservoir may be configurated as an annular band defining two opposing openings adapted to fit with the outer surface of said first wall snugly adjacent a mandrel shaped as a human foot with the heel portion of said mandrel projecting from one opening of said band and the toe portion of said mandrel projecting from the opposing opening of said band, said cavity including a member adjacent the instep portion of said mandrel.

12. A custom fitting member according to claim 11 wherein said reservoir walls are formed from plastic resin sheet material.

13. A custom fitting member according to claim 11 wherein said means for introducing a liquid resin reaction mixture is a conduit in open communication with said cavity extending from the outer surface of said second wall.

14. A custom fitting member according to claim 13 wherein said inner boot comprises resinous foam material, and said first wall of said member is comprised of said resinous foam material.

15. A custom fitting member according to claim 11 wherein said means for introducing liquid resin reaction mixture to said cavity comprises a pair of isolated compartments within said cavity, each of which contains a portion of the components of said reaction mixture, said compartments being isolated by removable barrier means.

16. A method for making a custom fitting inner boot for a ski boot comprising:

providing a mandrel in the shape of a human lower leg and foot;

providing a custom fitting member over said mandrel, said custom fitting member comprising flexible sheet material formed to define a cavity surrounding the ankle and instep portions of said mandrel with an injection conduit extending from open communication with said cavity away from said material;

providing an enclosure for said mandrel, the internal surface of said enclosure and the external surface of said mandrel together approximately defining the finished shape of said inner boot, and positioning said injection conduit for access at the inner surface of said enclosure;

injecting a liquid resin reaction mixture into the space between the mandrel and the enclosure, thereby to cause said space to become filled with pliable resinous foam; at least partially embedding said fitting member therein; and removing the thus-formed resinous foam and custom fitting member from the mandrel.

17. A method according to claim 16 wherein an inner liner element is paced over the mandrel prior to placement of the custom fitting member thereon, and the liquid resin reaction mixture is reacted in place within the space between the enclosure and the mandrel to form a bond with said inner liner.

18. A method according to claim 16 wherein the custom fitting member is shaped as an annular bond so that when it is positioned over the mandrel, the heel portion of the mandrel extends from one side of the bond and the toe portion of the mandrel extends from the opposite side of the band.

19. A method according to claim 16 wherein the custom fitting member comprises vinyl sheet material.

20. A method according to claim 16 wherein an opening is provided through said enclosure, and said conduit is placed through said opening so that when the thus-formed resinous foam is removed from the mandrel, the conduit projects therefrom.

21. A method according to claim 20 wherein an inner liner element comprising a two-way stretch fabric bonded to a closed cell resinous foam substrate is placed over the mandrel with said two-way stretch fabric adjacent said mandrel prior to placement of the custom fitting member thereon, and the liquid resin reaction mixture is reacted in place within the space between the enclosure and the mandrel to form a bond with said inner liner.

22. A method according to claim 21 wherein the custom fitting member is shaped as an annular band so that when it is positioned over the mandrel, the heel portion of the mandrel extends from one side of the band and the toe portion of the mandrel extends from the opposite side of the band.

23. A method according to claim 22 wherein the custom fitting member comprises vinyl sheet material.

24. An inner boot for a ski boot comprising:

a pliable boot of resinous foam material, bifurcated at the front with a first side overlapping a second side, the overlapping portion of said first side being received by a recessed portion of said second side, the outer surface of said inner boot including additional recessed portions in the vicinity of the shin region.

25. An inner boot according to claim 24 including said additional recessed portions adjacent the ankle bone region of said inner boot and a plurality of said additional recessed portions along the perimeter of said first named recessed portion.

* * * * *